US011835197B2

(12) United States Patent
Yan et al.

(10) Patent No.: US 11,835,197 B2
(45) Date of Patent: Dec. 5, 2023

(54) CEILING GRID MULTI-FUNCTIONAL LED LINEAR LAMP

(71) Applicant: Jiangmen Blue Vision Optoelectronics Co., Ltd., Jiangmen (CN)

(72) Inventors: Weijun Yan, Shenzhen (CN); Wujun Zhou, Ji'an (CN)

(73) Assignee: Jiangmen Blue Vision Optoelectronics Co., Ltd., Jiangmen (CN)

( * ) Notice: Subject to any disclaimer, the term of this patent is extended or adjusted under 35 U.S.C. 154(b) by 0 days.

(21) Appl. No.: 17/902,233

(22) Filed: Sep. 2, 2022

(65) Prior Publication Data

US 2023/0304639 A1 Sep. 28, 2023

(30) Foreign Application Priority Data

Mar. 28, 2022 (CN) ..... 202220692448.4
Mar. 28, 2022 (CN) ..... 202220697934.5

(51) Int. Cl.

| | |
|---|---|
| ***F21S 8/04*** | (2006.01) |
| ***F21V 5/04*** | (2006.01) |
| ***F21V 5/00*** | (2018.01) |
| ***F21S 4/28*** | (2016.01) |

(52) U.S. Cl.
CPC ..... *F21S 8/043* (2013.01); *F21S 4/28* (2016.01); *F21V 5/002* (2013.01); *F21V 5/04* (2013.01)

(58) Field of Classification Search
CPC ..... F21S 4/28; F21S 8/043; F21S 8/04; F21S 8/046; F16M 13/027; F21V 21/02; F21V 21/025; F21V 21/042; F21V 21/043; F21V 5/04; F21V 5/002
See application file for complete search history.

(56) References Cited

U.S. PATENT DOCUMENTS

| | | | | |
|---|---|---|---|---|
| 9,909,721 | B1 * | 3/2018 | Deng | F21V 15/015 |
| 11,732,878 | B2 * | 8/2023 | Porciatti | F21V 23/023 362/147 |
| 2005/0152132 | A1 * | 7/2005 | Bernhart | F21V 33/0088 362/147 |
| 2011/0002120 | A1 * | 1/2011 | Song | F21V 29/89 362/249.02 |
| 2011/0211330 | A1 * | 9/2011 | Wang | F21V 29/767 362/20 |
| 2012/0162974 | A1 * | 6/2012 | Yu | F21S 4/28 362/218 |
| 2012/0250302 | A1 * | 10/2012 | Edwards | F21V 31/005 362/223 |

(Continued)

FOREIGN PATENT DOCUMENTS

| | | | | |
|---|---|---|---|---|
| CN | 111299110 A | * | 6/2020 | |
| DE | 202012100992 U1 | * | 8/2013 | F21V 21/025 |

*Primary Examiner* — Erin Kryukova
(74) *Attorney, Agent, or Firm* — Georgi Korobanov

(57) ABSTRACT

The application discloses a ceiling grid multi-functional LED linear lamp, comprising: a main profile; an LED light bar, which is fixedly arranged on the inner bottom of the main profile; wherein both ends of the main profile are fixedly installed with mounting brackets, wherein the mounting bracket comprises a riveting bracket, a connecting piece and a movable bracket, the connecting piece is fixedly connected on one side of the bottom end of the riveting bracket, and the movable bracket is fixed on the back of the riveting bracket.

9 Claims, 6 Drawing Sheets

(56) References Cited

U.S. PATENT DOCUMENTS

| | | | | |
|---|---|---|---|---|
| 2012/0250309 | A1* | 10/2012 | Handsaker | F21S 4/28 362/235 |
| 2013/0094224 | A1* | 4/2013 | Miyatake | F21V 21/02 362/363 |
| 2013/0094225 | A1* | 4/2013 | Leichner | F21S 8/061 362/368 |
| 2019/0323688 | A1* | 10/2019 | Ko | F21V 19/003 |
| 2020/0200372 | A1* | 6/2020 | Béland | F21V 21/14 |

* cited by examiner

CEILING GRID MULTI-FUNCTIONAL LED LINEAR LAMP

CROSS-REFERENCE TO RELATED APPLICATIONS

This application claims the benefit and priority of Chinese patent application No. 202220697934,5, filed on Mar. 29, 2022 and No. 202220692448.4, filed on. Mar. 29, 2022, disclosure of which is hereby incorporated by reference in its entirety

TECHNICAL FIELD

The present application relates to the field of LED linear lamps, and more particularly, to a ceiling grid multi-functional LED linear lamp.

BACKGROUND

LED line lamp series is a kind of advanced flexible decorative lamp, which is characterized by low power consumption, long life, high brightness, easy to bend, maintenance-free, etc. It can be installed in single or multiple combinations, suitable for various buildings, indoor and outdoor local or contour lamping, especially suitable for indoor and outdoor entertainment venues, building outlines and billboard production. According to different needs, the product has 12V, 24V, etc., and the length is 30 CM, 60 CM, 90 CM, 1.20 CM, etc. Line lamps of different specifications can also be customized according to customer needs.

At present, the existing LED linear lamps on the market generally set reserved holes directly on the mounting plate, and use screws for manual fixation, Sometimes there may be no suitable screwing tools, which make the installation of LED linear lamps very inconvenient.

SUMMARY

The technical problem to be solved by the present application is to provide a ceiling grid multi-functional LEI) linear lamp that is easy to install.

The purpose of the present application is achieved through the following technical solutions:

A ceiling grid multi-functional LED linear lamp, comprising:

a main profile;

an LED light bar, which is fixedly arranged on an inner bottom of the main profile; wherein both ends of the main profile are fixedly installed with mounting brackets, wherein the mounting bracket comprises a riveting bracket, a connecting piece and a movable bracket, the connecting piece is fixedly connected on one side of the bottom end of the riveting bracket, and the movable bracket is fixed on back of the riveting bracket.

Furthermore, a stud is fixedly connected to outer surface of the movable bracket, a mounting groove is formed on outer surface of the riveted bracket, and the stud is movable inserted into interior of the mounting groove, and a winged nut is threaded on outer surface of an end of the stud.

Furthermore, positioning bars are fixedly connected to both sides of outer surface of the movable bracket, and the riveted bracket is installed between the two positioning bars.

Furthermore, the connecting piece is movably inserted into interior of the main profile, outer surfaces of the main profile and the connecting piece are provided with mounting holes, and rivets are fixedly installed in the inside of the mounting holes.

Furthermore, the LED linear lamp comprises an LED lampshade, and the LED light bar comprises a PCB board and LED lamp beads, the LED lampshade is fixedly installed on bottom of the main profile, the LED lampshade is arranged opposite to a side of the PCB board where the LED lamp beads are arranged.

Furthermore, the LED lampshade comprises a mask, and the mask is PC diffusion frosted.

Furthermore, the LED lampshade comprises a UGR mask, and the UGR mask is a combination of PC diffusion frosting and PC prism.

Furthermore, the LED lampshade comprises a square lens, the square lens comprises a PC lens and a PC square lamp cup, and an aluminum panel is fixedly installed on lower surface of the square lens.

Furthermore, the LED lampshade comprises a circular lens, the circular lens comprises a PC lens and a PC circular optical cup, and an aluminum panel is fixedly installed on lower surface of the circular lens.

Furthermore, plugs are fixedly installed on both ends of the bottom of the main profile, and the plugs are fixed on both ends of the bottom of the main profile by screws, and a limit protrusion is provided on side of the connecting piece.

The present application discloses a ceiling grid multifunctional LED linear lamp, which has the following beneficial effects:

1. When installing the multi-functional LED linear lamp, the user should first put the hanging fixture of the lamp on the outer surface of the stud, and then buckle the movable bracket on the back of the riveting bracket, so that the riveting bracket is located in two positioning bars. At the same time, the stud is inserted into the interior of the mounting groove, and at this time, it is fixed by the winged nut, which is convenient for the quick installation of the lamp on the external hanging fixture.
2. In this multi-functional LED linear lamp, the winged nut is installed on the outer surface of the stud. In actual installation, it only needs to be screwed by hand, without professional tools, and the operation is more convenient.

In this multifunctional LED linear lamp, an LED lampshade is arranged at the bottom of the same type of linear LED lamp, and the main body shape and size of the LED lampshade are the same, but the internal structure has various farms to meet different customer needs. In the later stage, different light and shadow shapes can be realized by replacing the LED lampshade, which has better use value and economic benefits.

REFERENCE SIGNS

Figure 1:
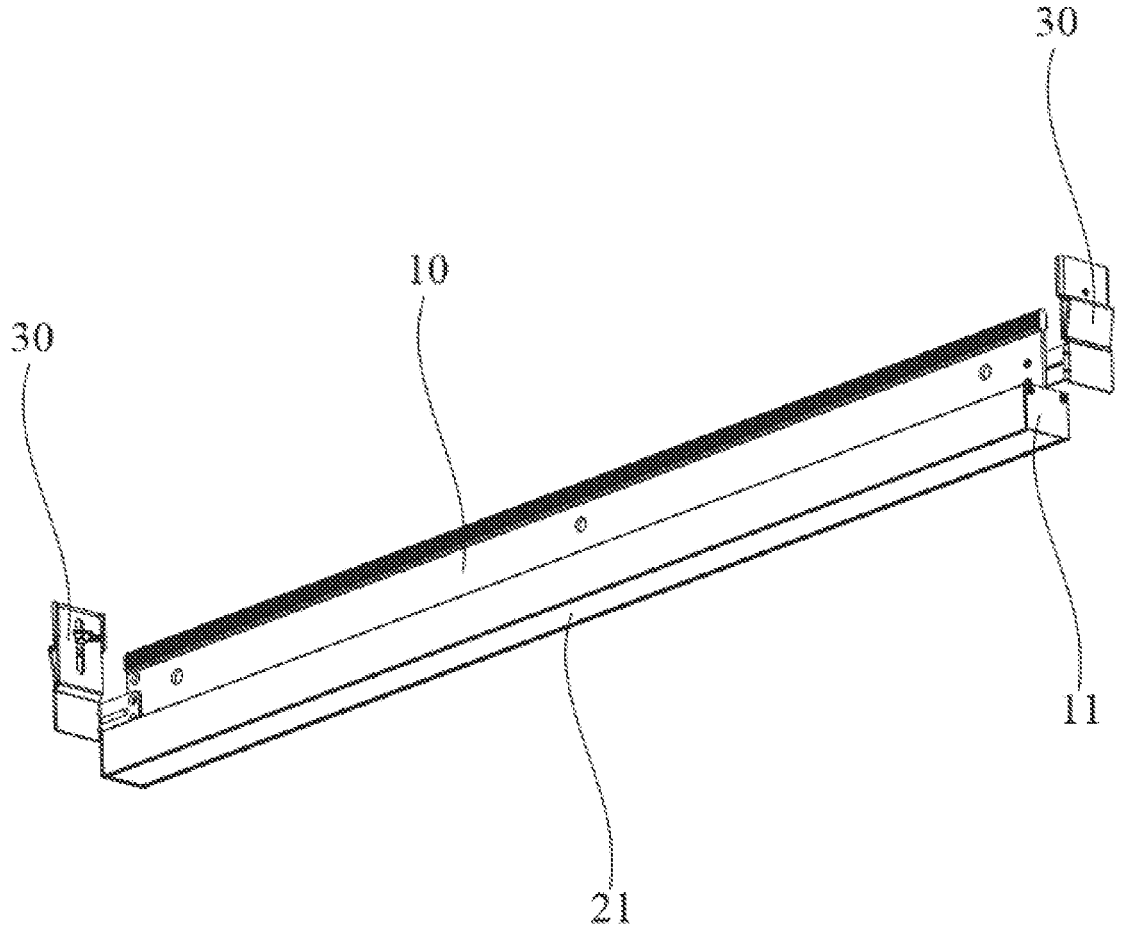
FIG. 1 is a schematic structural diagram of an LED linear lamp according to an embodiment of the present application.

10. Main profile; 11, Plug; 20. LED light bar; 21. LED lampshade; 22. Mask; 23. UGR mask; 24. Square lens; 25. Circular lens; 26. Aluminum panel; 30. Mounting bracket; 31. Riveting bracket; 32. Connecting piece, 321, Limit protrusion; 33. Movable bracket; 34. Positioning bar; 35. Mounting groove; 36. Stud; 37. Winged nut; 38. Rivet; 39. Mounting holes.

DETAILED DESCRIPTION

In the description of the present application, it should be noted that the terms "center", "lateral", "top", "bottom", "left", "right", "vertical", "horizontal", "top",etc. which are used to indicate position or positional relationship are based on the position or positional relationship shown in the drawings, and are only for the convenience of describing the application and simplifying the description, rather than indicating or implying that the indicated position or element must have a specific orientation and be constructed in a specific orientation and operation, therefore cannot be understood as a limitation of the present application. In addition, the terms "first" and "second" are only used for descriptive purposes, and should not be understood as indicating or implying relative importance or implying the number of indicated technical features. Thus, a feature defined as "first" or "second" may expressly or implicitly includes one or more of that feature.

In the description of this application, unless stated otherwise, "plurality" means two or more. Additionally, the term "comprising" and any variations thereof are intended to cover non-exclusive inclusion.

In the description of the present application, it should be noted that unless otherwise clearly specified and limited, the terms "installation", and "connection" should be understood in a broad sense, for example, it can be a fixed connection or a detachable connection, or integrally connected; it can be a mechanical connection or an electrical connection; it can be directly connected, or indirectly connected through an intermediate medium, and it can be the internal communication between two components. For those skilled in the art, the specific meaning of the above-mentioned terms in the present application can be understood according to the specific circumstances.

By observing the way of directly setting reserved holes on the mounting plate of the existing LED linear lamp, the inventor creatively used the independent copper nail riveting separation method to rivet the finished lamp and the mounting bracket assembly through the third part. Usually the third part is a copper turning part, and the nut shape of the mounting bracket is also round or other special shape. Through the above improvement, the LED linear lamp can be installed with convenience compared to the way of directly using screws and directly setting reserved holes on the mounting plate.

However, small parts such as the third part of copper car parts are too difficult to assemble for production operations, with low production efficiency and high production costs; It is easy to hurt your hand or not tighten it when you operate the round or other special-shaped nuts with your bare hands, and the bracket is also easy to deform. The material selection and process are also very important, which will bring great trouble to the installation or construction. These solutions have many obstacles in actual production or engineering applications, and the later maintenance operations are also inconvenient.

For the improvement of the above-mentioned. LED linear lamp mounting bracket of the inventor, it also has certain limitations, operability, safety, firmness, difficulty in maintenance, and high cost. At the same time, there are also shortcomings in energy saving and environmental protection. It goes against the concept of LED green environmental protection.

Therefore, the mounting bracket and other components of the LED linear lamp are improved again to make the installation of the LED linear lamp more convenient and simple. Through the improvement of other components, the applicability of the LED linear lamp is further broadened, and it can better meet the needs of different customers.

The present application will be further described below with reference to the accompanying drawings and preferred embodiments.

As shown in FIG. 1 to FIG. 6, the present embodiment discloses a ceiling grid multi-functional LED linear lamp, comprising: a main profile 10; an LED light bar 20, which is fixedly arranged on an inner bottom of the main profile 10; wherein both ends of the main profile 10 are fixedly installed with mounting brackets 30, wherein the mounting bracket 30 comprises a riveting bracket 31, a connecting piece 32 and a movable bracket 33, the connecting piece 32 is fixedly connected on one side of the bottom end of the riveting bracket 31, and the movable bracket 33 is fixed on back of the riveting bracket 31.

A stud 36 is fixedly connected to outer surface of the movable bracket 33, a mounting groove 35 is formed on outer surface of the riveted bracket 31, and the stud 36 is movable inserted into interior of the mounting groove 35, and a winged nut 37 is threaded on outer surface of an end of the stud 36. In actual installation, you only need to screw it by hand, without the need for professional tools, and the operation is more convenient.

Positioning bars 34 are fixedly connected to both sides of outer surface of the movable bracket 33, and the riveted bracket 31 is installed between the two positioning bars 34. As a result, deflection of the movable bracket 33 during installation is avoided.

Figure 2:
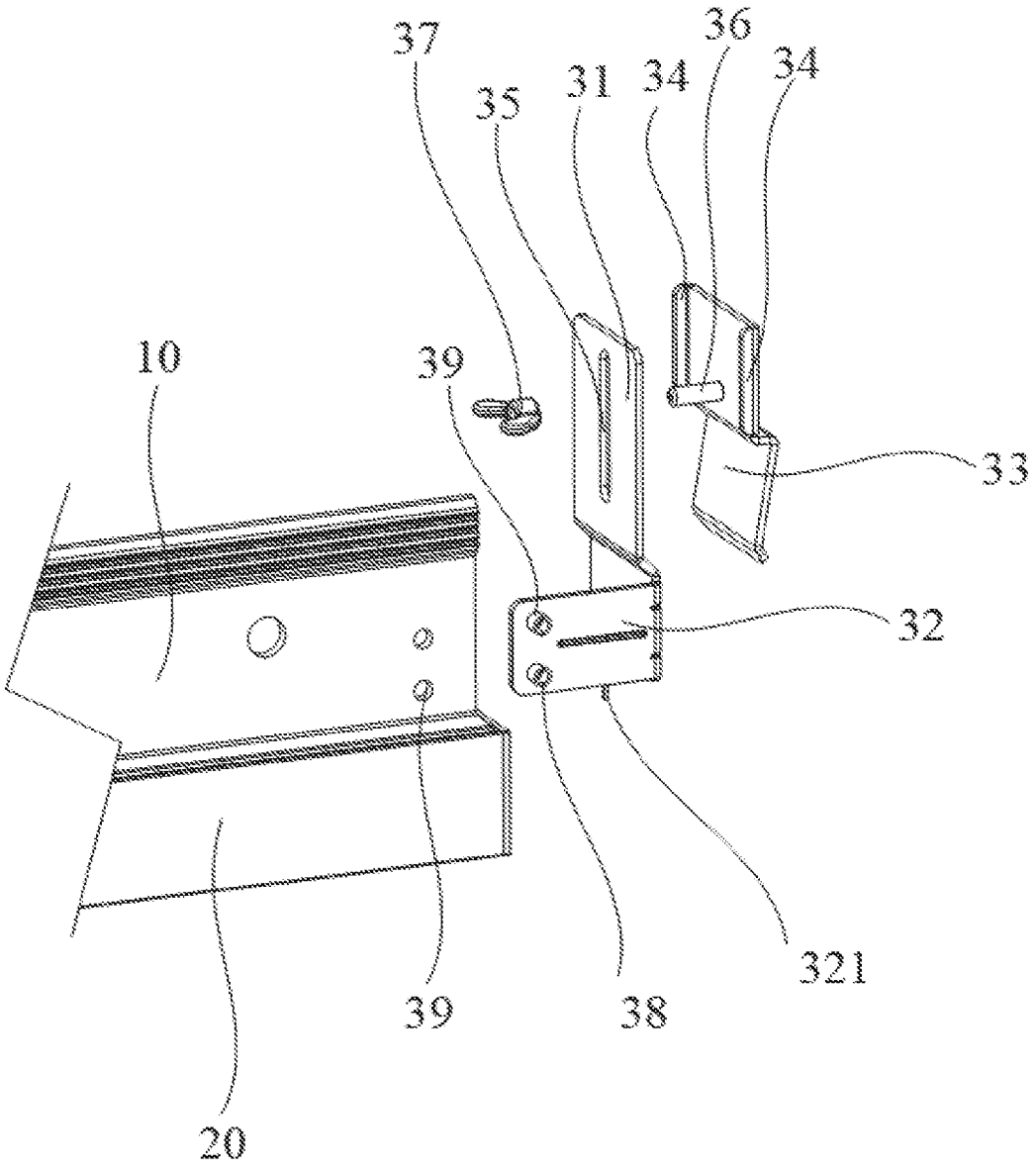
FIG. 2 is a schematic structural diagram of a mounting bracket for an LED linear lamp according to an embodiment of the present application.
Figure 3:
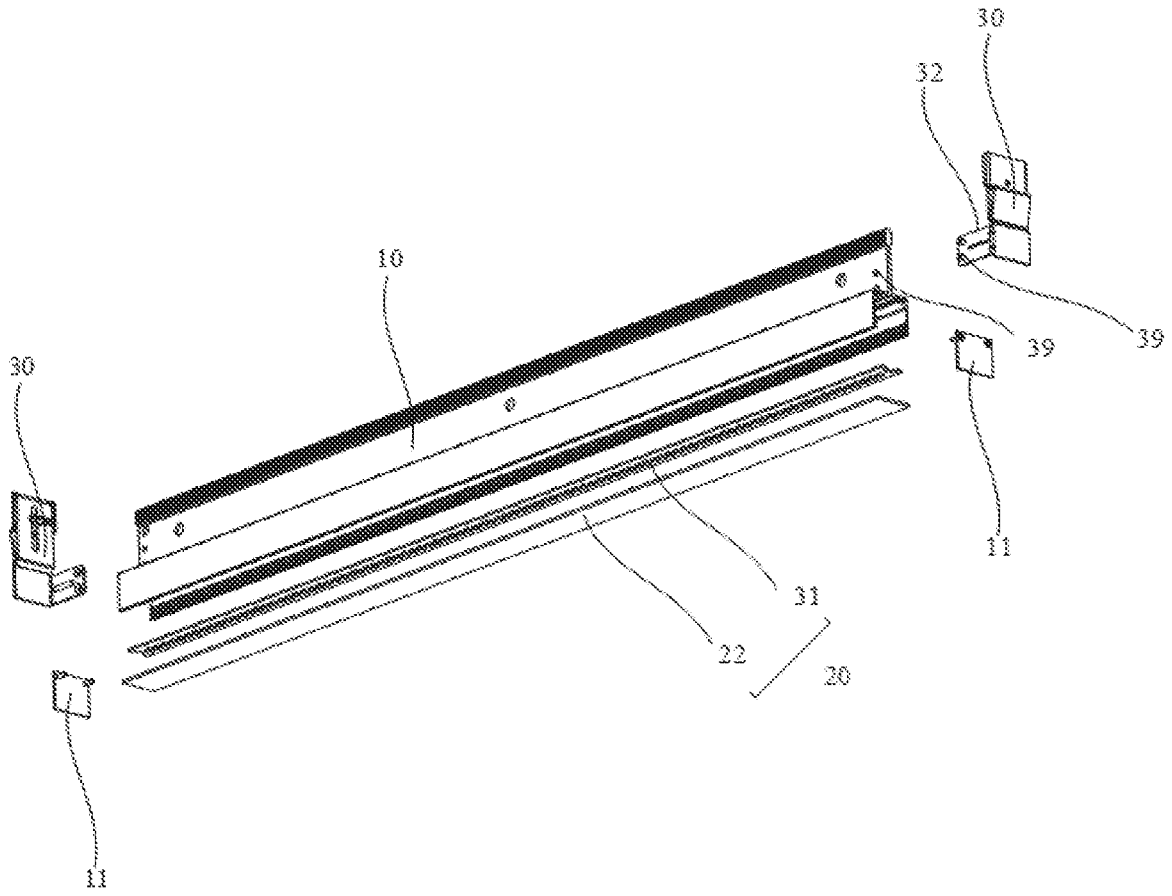
FIG. 3 is the exploded view of the LED linear lamp according to an embodiment of the present application.

The connecting piece 32 is movably inserted into interior of the main profile 10, outer surfaces of the main profile 10 and the connecting piece 32 are provided with mounting holes 39, and rivets 38 are fixedly installed in the inside of the mounting holes 39. During actual production, the connecting piece 32 is inserted into the interior of the main profile 10 so that the connecting piece 32 is directly opposite to the mounting hole 39 on the side of the main profile 10. Then, the rivets 38 are installed in the interior for fixing by using riveting equipment, so as to form an integrated structure when leaving the factory; optionally, as shown in FIG. 2, a limit protrusion 321 is provided on the side of the connecting piece 32. When the LED linear lamp is installed, the mounting bracket 30 is fixed to the ceiling, and the limiting protrusion 321 can play a very good limiting role, thereby further ensuring that the LED linear lamp can be positioned accurately. In this way, the LED linear lamp is not easy to slide on both sides, which is more convenient for the installation of the LED linear lamp, and further improves the installation efficiency of the LED linear lamp.

In terms of design, material and process, the movable bracket 33 and the riveted bracket 31 are made of 45-gauge hardened carbon steel or 304 stainless steel. In terms of stamping, the riveting bracket 31 has a unique design with a chicken hole reverse eye, which is inserted into the hole of the main profile 10 by using the chicken reverse eye, and is directly riveted by riveting equipment to form an integral. shape. The winged nut 37 will be made of 304 stainless steel with a full arc shape, which does not hurt the hand and can meet the use of various LED linear lamps or modeling lamps. It is not limited by length or shape, and has a good experience effect.

When installing the multi-functional. LED linear lamp, the user should first put the hanging fixture of the lamp on the outer surface of the stud 36, and then buckle the movable bracket 33 on the back of the riveting bracket 31, so that the riveting bracket 31 is located in two positioning bars 34. At the same time, the stud 36 is inserted into the interior of the mounting groove 35, and at this time, it is fixed by the winged nut 37, which is convenient for the quick installation of the lamp on the external hanging fixture.

The LED linear lamp comprises an LED lampshade 21, and the LED light bar 20 comprises a PCB board and LED lamp beads, the LED lampshade 21 is fixedly installed on bottom of the main profile 10, the LED lampshade 21 is arranged opposite to a side of the PCB board where the LED lamp beads are arranged. Plugs 11 are fixedly installed on both ends of the bottom of the main profile 10, and the plugs 10 are fixed on both ends of the bottom of the main profile 10 by screws, and a limit protrusion is provided on side of the connecting piece. The plug 11 can effectively limit and fix the LED light bar 20 and the LED lampshade 21, and at the same time effectively shield the inner wall of the main profile 10, which further improves the aesthetics of the LED linear lamp. The mounting brackets 30 are fixed to the top ends of the main profile 10 by rivets 38. Plug 11 is 6063 aluminum alloy. Such LED lampshade 21 has a relatively simple shape and low cost. The LED lampshade 21 comprises a mask 22, and the mask 22 is PC diffusion frosted. The PC diffused frosted mask 22 can make the light softer and further ensure the comfort of using the LED linear lamp.

Figure 4:
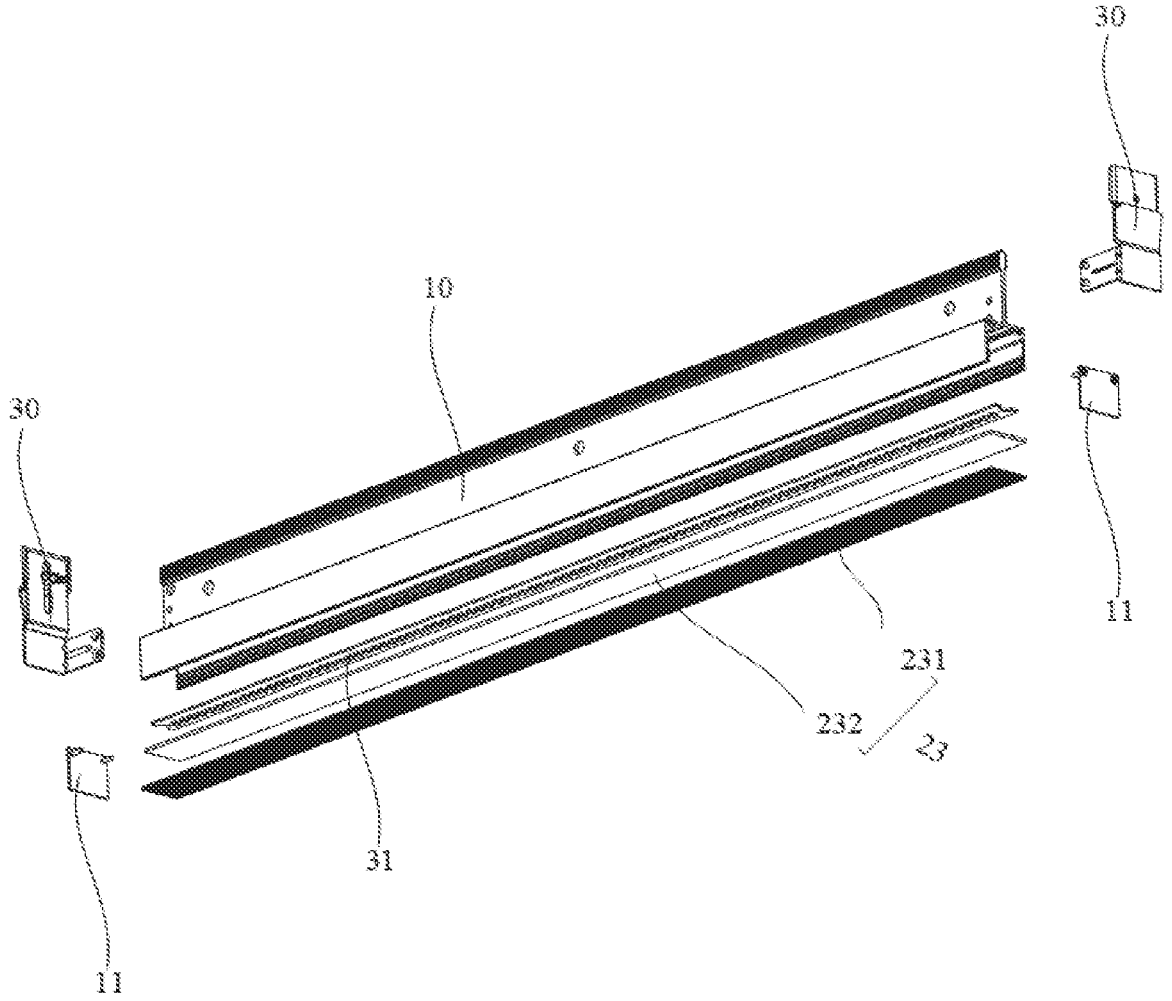
FIG. 4 is the exploded view of the LED) linear lamp with UGR lampshade according to an embodiment of the present application.

Optionally, as shown in FIG. 4, the LED lampshade 21 comprises a UGR mask 23, which is a combination of PC diffusion frosting and PC prism. The cost of using the UGR mask 23 structure is relatively low, but it has more refracting light and shadow effects than PC diffuser frosting.

Figure 5:
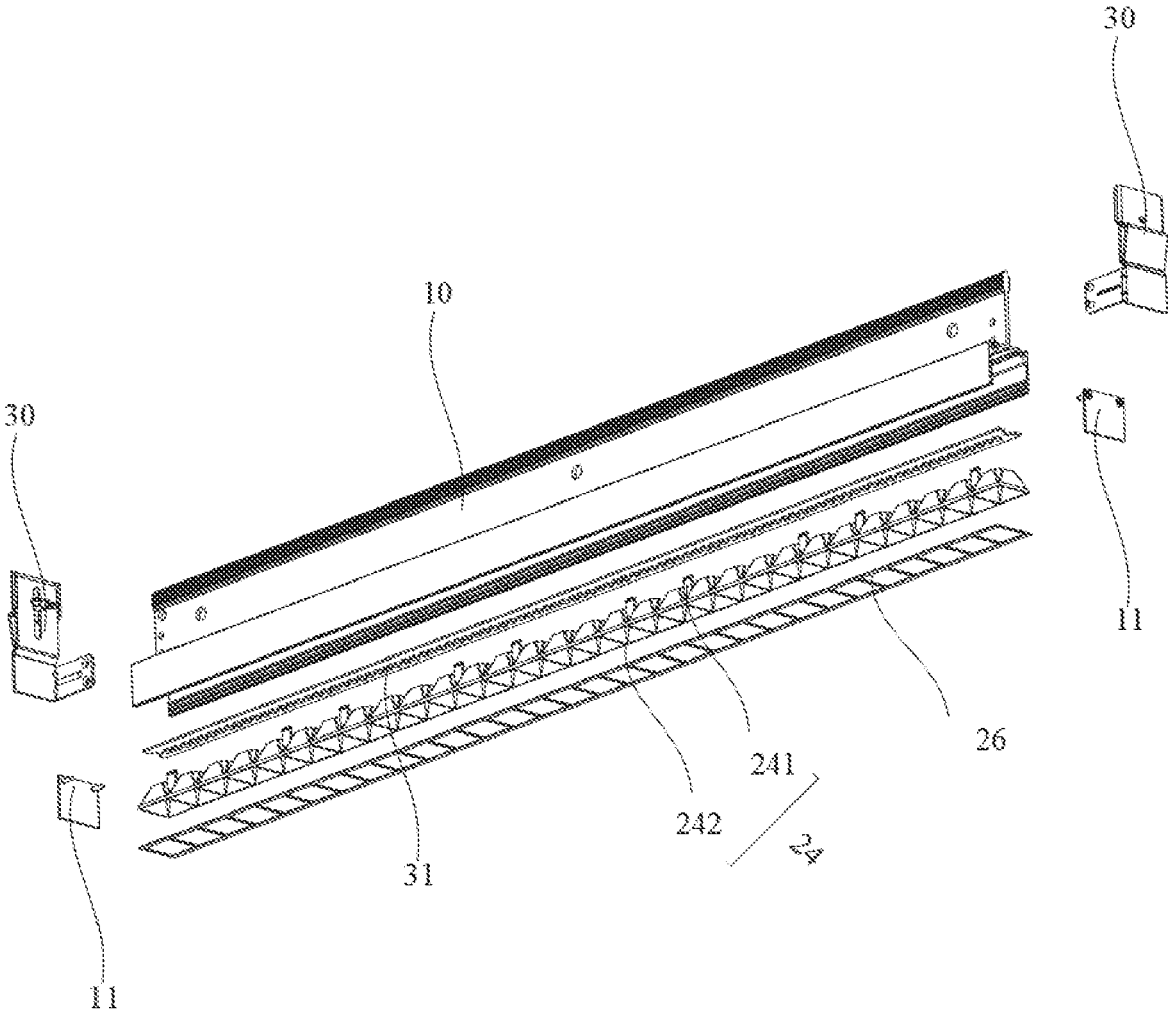
FIG. 5 is an exploded view of the LED linear lamp with a square lens according to an embodiment of the present application.

Optionally, as shown in FIG. 5, the LED lampshade 21 comprises a square lens 24, the square lens 24 comprises a PC lens and a PC square optical cup, and an aluminum panel 26 is fixedly mounted on the lower surface of the square lens 24. Such a square lens 24 has a special refraction effect and is more beautiful.

Figure 6:
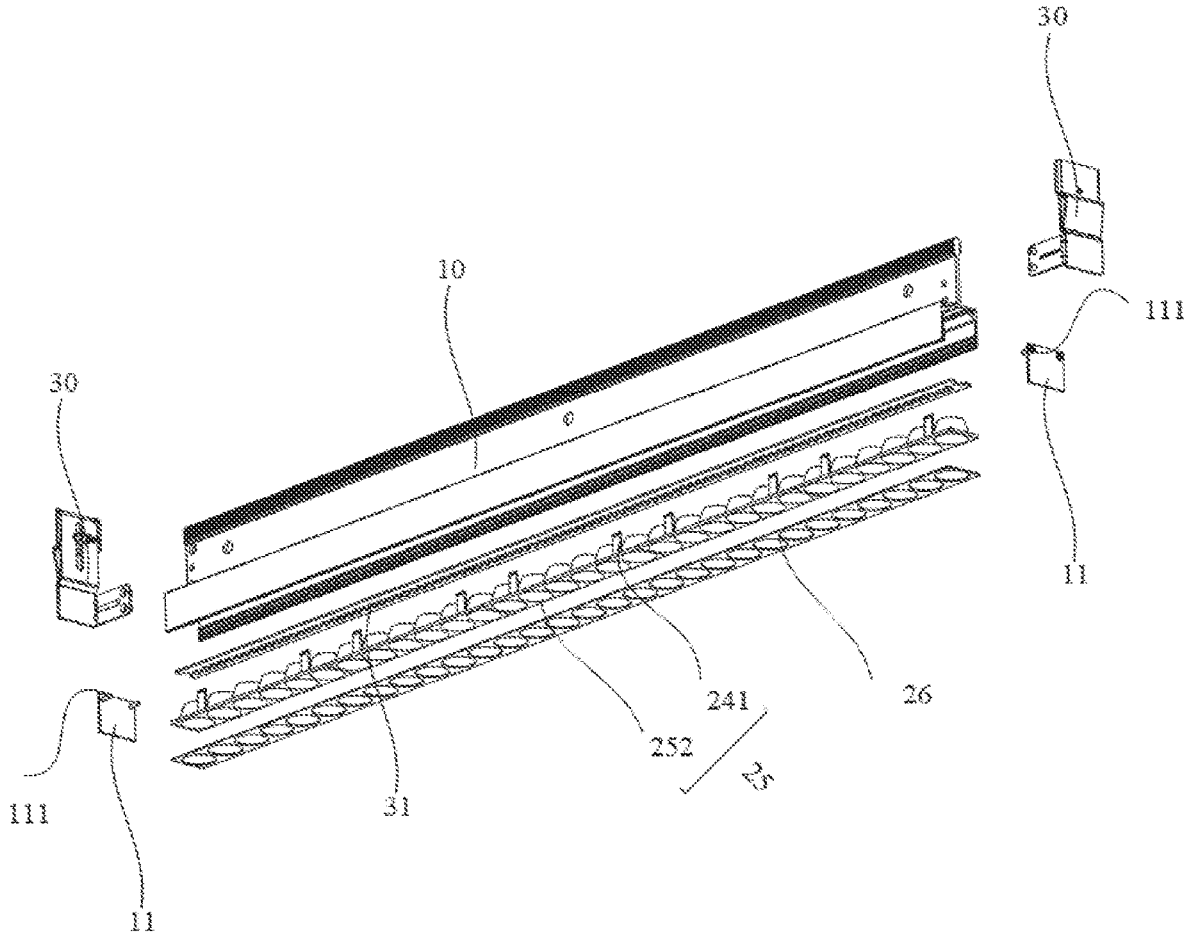
FIG. 6 is an exploded view of the LED linear lamp with a circular lens according to an embodiment of the present application.

Optionally, as shown in. FIG. 6, the LED lampshade 21 comprises a circular lens 25, the circular lens 25 comprises a PC lens and a PC circular optical cup, and an aluminum panel 26 is fixedly mounted on the lower surface of the circular lens 25. The circular lens 25 and the square lens 24 also have a special refraction effect, which is more beautiful, but the shape of the refraction light and shadow is different from that of the square lens 24.

The above content is a further detailed description of the present application in conjunction with specific preferred embodiments, and it cannot be considered that the specific implementation of the present application is limited to these descriptions. Therefore, any modification, equivalent replacement, improvement, etc. made to the above embodiments according to the technical practice of the present application still fall within the scope of the technical solution of the present application.

What is claimed is:

1. A ceiling grid LED linear lamp, comprising:

a body having a main profile and a first end and a second end;

an LED light bar, which is fixedly arranged on an inner bottom of the main profile; wherein both ends of the main profile are fixedly installed with mounting brackets, wherein each mounting bracket comprises a bracket, a connecting piece and a movable bracket, the connecting piece is fixedly connected on one side of a bottom end of the bracket, and the movable bracket is fixed on back of the bracket;

wherein a stud is fixedly connected to an outer surface of the movable bracket, a mounting groove is formed on an outer surface of the bracket, and the stud is movable inserted into an interior of the mounting groove, and a winged nut is threaded on an outer surface of an end of the stud.

2. The ceiling grid LED linear lamp according to claim 1, wherein positioning bars are fixedly connected to both sides of the outer surface of the movable bracket, and the bracket is installed between the two positioning bars.

3. The ceiling grid LED linear lamp according to claim 1, wherein the connecting piece is movably inserted into an interior of the main profile, outer surfaces of the main profile and the connecting piece are provided with mounting holes, and rivets are fixedly installed in the inside of the mounting holes.

4. The ceiling grid LED linear lamp according to claim 1, wherein the LED linear lamp comprises an LED lampshade, and the LED light bar comprises a PCB board and LED lamp beads, the LED lampshade is fixedly installed on a bottom of the main profile, the LED lampshade is arranged opposite to a side of the PCB board where the LED lamp beads are arranged.

5. The ceiling grid LED linear lamp according to claim 4, wherein the LED lampshade comprises a mask, and the mask is PC diffusion frosted.

6. The ceiling grid LED linear lamp according to claim 4, wherein the LED lampshade comprises a UGR mask, and the UGR mask is a combination of PC diffusion frosting and PC prism.

7. The ceiling grid LED linear lamp according to claim 4, wherein the LED lampshade comprises a square lens, the square lens comprises a PC lens and a PC square lamp cup, and an aluminum panel is fixedly installed on a lower surface of the square lens.

8. The ceiling grid LED linear lamp according to claim 4, wherein the LED lampshade comprises a circular lens, the circular lens comprises a PC lens and a PC circular optical cup, and an aluminum panel is fixedly. installed on a lower surface of the circular lens.

9. The ceiling grid LED linear lamp according to claim 1, wherein plugs are fixedly installed on both ends of the bottom of the main profile, and the plugs are fixed on both ends of the bottom of the main profile by screws, and a limit protrusion is provided on a side of the connecting piece.

* * * * *